United States Patent [19]

Anderson

[11] 4,050,395

[45] Sept. 27, 1977

[54] ARTICULATED HULL CONSTRUCTION

[76] Inventor: Thomas M. Anderson, P. O. Box 2593, Kodiak, Alaska 99615

[21] Appl. No.: 671,364

[22] Filed: Mar. 29, 1976

[51] Int. Cl.[2] ..... B63B 3/02

[52] U.S. Cl. ..... 114/77 R; 9/2 S

[58] Field of Search ..... 114/77 R, 67 A, 66.5 S, 114/235 R, 235 A, 242, 248, 249, 250, 251, 291; 115/4, 41 HT; 9/2 R, 2 S

[56] References Cited

U.S. PATENT DOCUMENTS

| | | | |
|---|---|---|---|
| 696,097 | 3/1902 | Graham | 114/77 R |
| 1,304,318 | 5/1919 | Jackson | 115/4 |
| 2,441,999 | 5/1948 | Fulke | 114/77 R |
| 2,776,637 | 1/1957 | Chadwick | 114/77 R |
| 3,035,536 | 5/1962 | Archer | 114/77 R |
| 3,145,681 | 8/1964 | Nakagawa | 114/77 R |
| 3,266,067 | 8/1966 | Windle | 114/67 A |
| 3,285,221 | 11/1966 | North | 115/41 HT |
| 3,512,495 | 5/1970 | Fletcher | 114/77 R |
| 4,000,712 | 1/1977 | Erikson et al. | 114/77 R |

*Primary Examiner*—Trygve M. Blix
*Assistant Examiner*—Charles E. Frankfort
*Attorney, Agent, or Firm*—Clarence A. O'Brien; Harvey B. Jacobson

[57] ABSTRACT

A boat hull is provided including fore and aft hull sections pivotally interconnected for relative angular displacement of said sections about a horizontal transverse axis between predetermined limits. Connecting structure is provided and interconnected between the sections and adjustably yieldingly resists relative angular displacement of the hull sections. In addition, the connecting structure is operative to adjustably vertically position the axis of relative oscillation of the sections relative to the fore section and the fore and aft sections include generally longitudinally straight adjacent bottom surface portions with the bottom surface portion of the aft section being spaced above the level of the bottom surface portion of the fore section, even when the axis of relative oscillation of the sections is adjusted to its lowest position relative to the fore section.

11 Claims, 9 Drawing Figures

Fig. 3
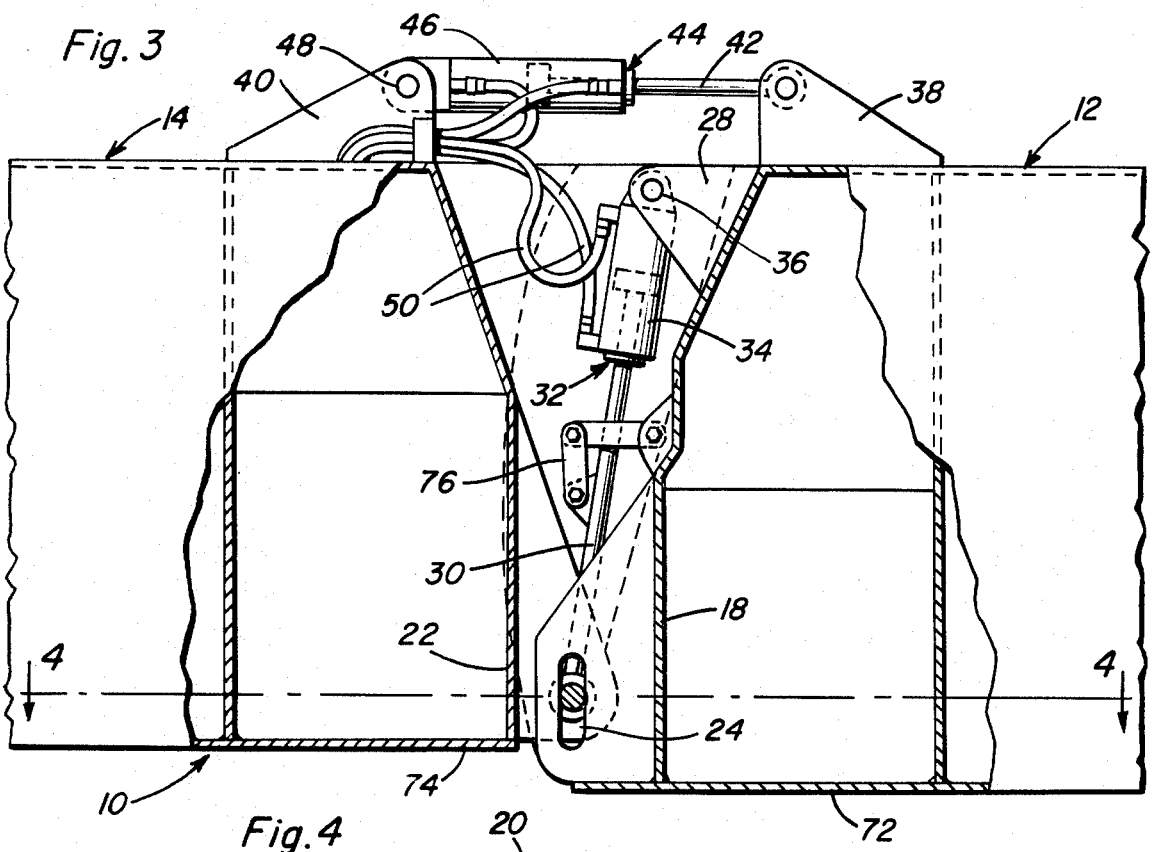
Fig. 4
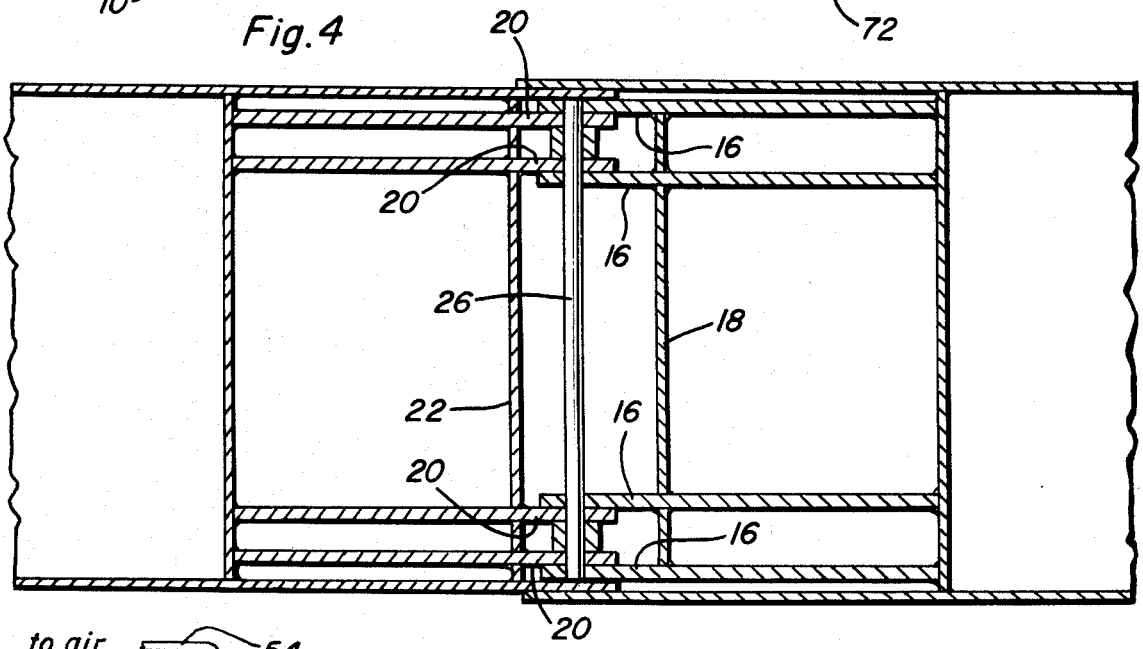
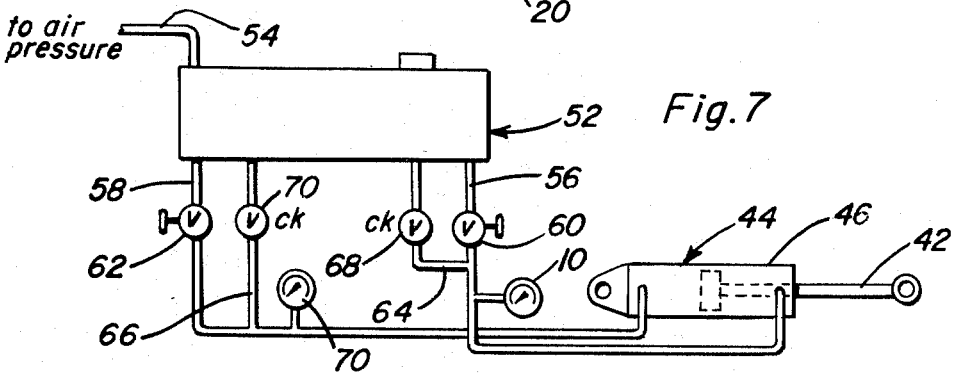
Fig. 7

ARTICULATED HULL CONSTRUCTION

BACKGROUND OF THE INVENTION

A well designed conventional planing hull increases the transverse metacenter and at the same time lowers the longitudinal metacenter while longitudinal metacenter of a stepped planing hull is necessarily increased and the hull tends to plunge through rather than ride over steep waves. A hull having a low metacenter allows change of trim with sufficient rapidity for the hull to accommodate itself to normal wave slopes.

While various ship hull constructions have incorporated articulated hull designs in an attempt to increase the ability of the hull to ride over waves with reduced pitching, these previous attempts have not been wholly effective for various reasons. Examples of various forms of articulated hulls are disclosed in U.S. Pat. Nos. 45,039, 2,715,380, 2,747,536, 3,035,536, 3,145,681 and 3,307,564.

BRIEF DESCRIPTION OF THE INVENTION

The hull construction of the instant invention includes fore and aft hull sections pivotally interconnected for relative angular displacement about a low horizontal transverse axis and the front and rear hull sections include longitudinally straight adjacent bottom planing surface portions with the bottom planing surface portion of the aft hull elevated at least slightly above the bottom planing surface portion of the fore hull, thereby defining a step. In addition, the fore and aft hull sections are interconnected by structure serving to dampen relative angular displacement of the fore and aft hull sections with the result that the improved performance characteristics of a stepped planing hull are retained without the increased tendency of a stepped planing hull to pitch when riding over waves.

The main object of this invention is to provide a planing hull of the stepped type enjoying the seaworthiness in riding over waves achieved by a hull having a metacenter lower than that which may be achieved by conventional stepped hulls.

Another object of this invention is to provide a stepped hull construction constructed in a manner whereby the vertical extent of the effective step may be varied.

Still another object of this invention is to provide a stepped hull construction defined by vertically spaced high and low, front and rear planing surfaces of aft and fore hull sections pivotally joined for relative oscillation about a horizontal transverse axis at their adjacent ends.

Still another object of this invention, in accordance with the immediately preceding object, is to provide an articulated hull construction including structure connected therebetween for dampening relative oscillation of the hull sections.

Another important object of this invention, in accordance with the immediately preceding object, is to provide an oscillation dampening structure which is variably adjustable.

A final object of this invention to be specifically enumerated herein is to provide a hull construction in accordance with the preceding objects and which will conform to conventional forms of manufacture, be of simple construction and offer increased performance and ride characteristics so as to provide a device that will be economically feasible, durable and more pleasurable and safer in use.

These together with other objects and advantages which will become subsequently apparent reside in the details of construction and operation as more fully hereinafter described and claimed, reference being had to the accompanying drawings forming a part hereof, wherein like numerals refer to like parts throughout.

Figure 5:
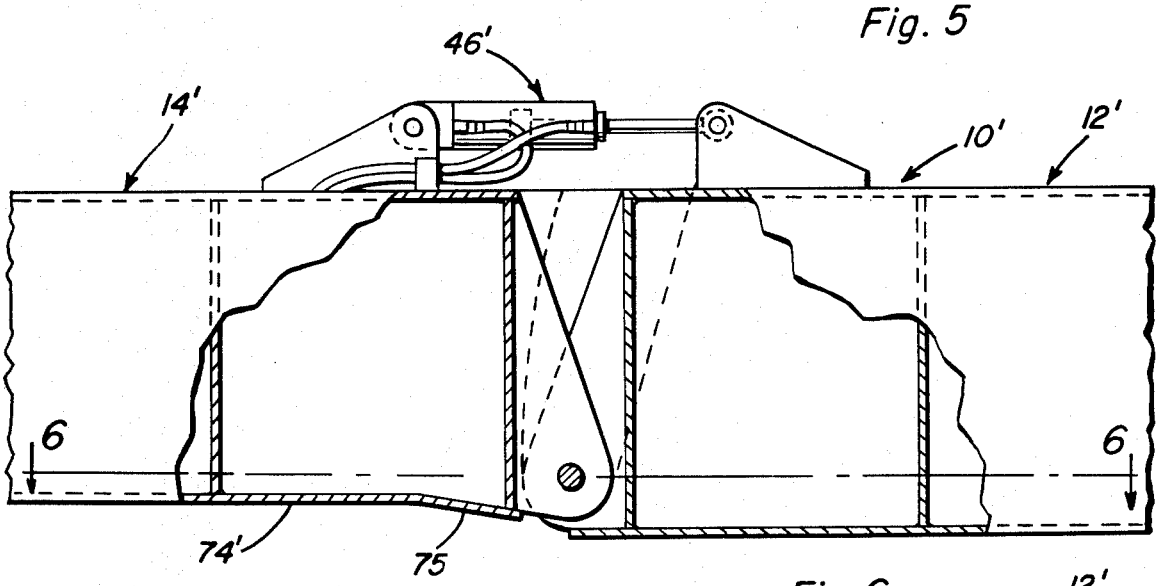
Figure 6:
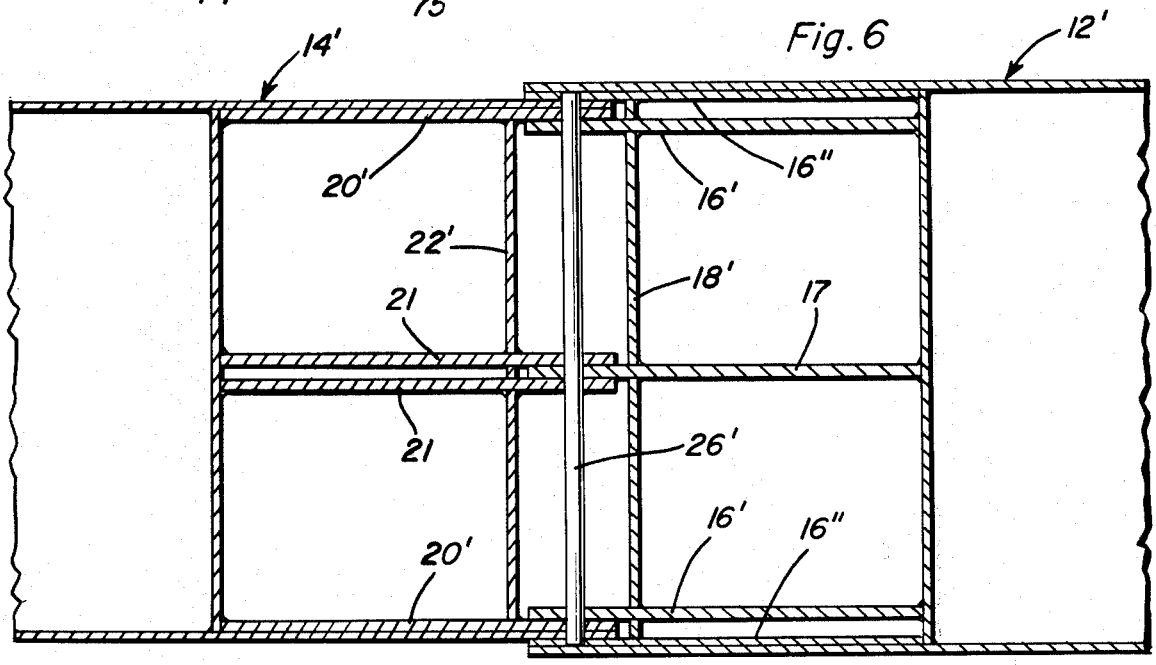
Figure 8:
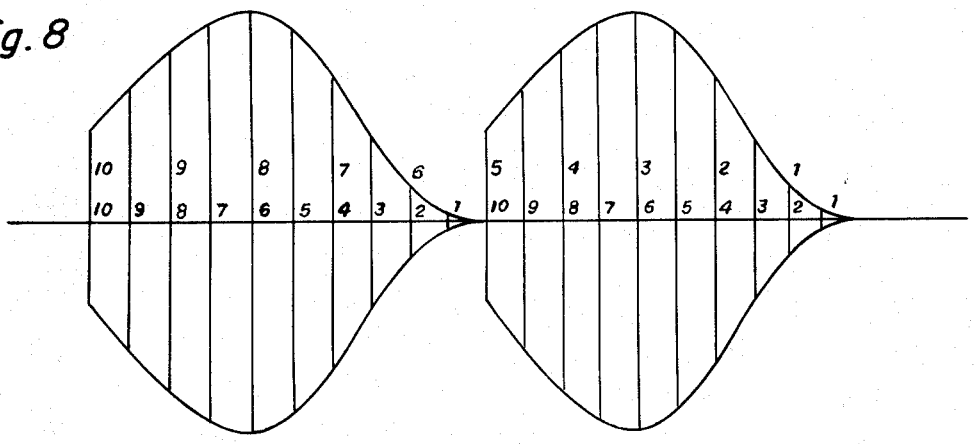

FIG. *2a* illustrates the manner in which a conventional rigid planing hull rides over wave crests and down into wave troughs, the centers of gravity and fore and aft centers of lift being indicated thereon;

FIG. *2b* is a view similar to FIG. *2a* but illustrating the manner in which the hull of the instant invention rides over wave crests and down into wave troughs;

FIG. 3 is a fragmentary enlarged side elevational view of a first form of boat hull constructed in accordance with the present invention with portions thereof being broken away to illustrate the oscillation dampening structure and the vertically adjustable axis of relative oscillation;

FIG. 4 is a fragmentary horizontal sectional view taken substantially upon the plane indicated by the section line 4—4 of FIG. 3;

FIG. 5 is a fragmentary enlarged side elevational view similar to FIG. 3 but of a second form of hull construction utilizing a non-vertically adjustable axis of relative oscillation;

FIG. 6 is a horizontal sectional view taken substantially upon the plane indicated by the section line 6—6 of FIG. 5;

FIG. 7 is a schematic view of the hydraulic circuit of the oscillation dampening structure illustrating only one of the double acting hydraulic cylinders; and FIG. 8 is a diagrammatic view graphically illustrating the water plane area of dynamic moments of the hull construction at planing speeds.

DETAILED DESCRIPTION OF THE INVENTION

Referring now more specifically to the drawings, the numeral 10 generally designates a first form of boat hull constructed in accordance with the present invention. The hull 10 includes a fore hull section referred to in general by the reference numeral 12 and an aft hull section referred to in general by the reference numeral 14. The fore and aft sections 12 and 14 may be of conventional design substantially as though they were formed by cutting a semi-V hull or other conventional form of hull section in half. However, the rear portion of the fore section includes opposite side pairs of transversely spaced mounting plates 16 projecting rearwardly of a rear bulkhead 18 and the front end of the aft section includes opposite side pairs of transversely spaced mounting plates 20 projecting forwardly of a forward transverse bulkhead 22. The mounting plates 16 are provided with transversely registered vertical slots 24 and a pivot shaft 26 has its opposite end portions rotatably received through the mounting plates 20 and slidably received in the corresponding slots 24, each pair of plates 20 being received between the corresponding pair of plates 16.

The fore section 12 additionally includes opposite side pairs of transversely spaced upper mounting plates 28 substantially vertically registered with the corresponding mounting plates 16 and the free ends of the piston rod portions 30 of a pair of double acting hydraulic cylinders referred to in general by the reference numerals 32 are mounted on the corresponding ends of the shaft 26 between the corresponding mounting plates 20. The upper ends of the cylinder portions 32 of the hydraulic cylinder assemblies 32 are pivotally anchored as at 36 between the corresponding pair of mounting plates 28. In addition, the aft end of the fore section 12 has a third pair of mounting plates 38 on each side thereof and corresponding pairs of mounting plates 40 are carried by the forward end of the aft section 14. The forward free ends of piston rod portions 42 of hydraulic cylinder assemblies referred to in general by the reference numerals 44 are pivotally anchored between the corresponding plates 38 and the rear ends of the cylinder portions 46 of the cylinder assemblies 44 are pivotally anchored between the corresponding plates 40 as at 48.

Pairs of suitable hydraulic lines 50 extend between opposite ends of the cylinder portions 34 and a suitable source (not shown) of hydraulic fluid provided with suitable controls and accordingly, the hydraulic cylinder assemblies 32 may be utilized to raise and lower the pivot shaft 26 in the slots 24. Of course, the sections 12 and 14 are interconnected by means of the pivot shaft 26 for relative oscillation about the shaft 26 and by raising the shaft 26 the axis of relative oscillation of the sections 12 and 14 is elevated relative to the section 12.

With attention now invited more specifically to FIG. 7 of the drawings the numeral 52 generally designates a closed hydraulic accumulator into which air under pressure may be admitted through an air pressure line 54 from a suitable source (not shown) of air under pressure, the air within the accumulator 52 being disposed over the level of hydraulic fluid within the accumulator 52.

In FIG. 7 only one of the cylinder assemblies 44 is illustrated but it is believed that the operation of the hydraulic system will be readily appreciated by the following description of only one of the cylinder assemblies 44.

A pair of hydraulic lines 56 and 58 extend between the reservoir 52 and opposite ends of the cylinder portion 46. The lines 56 and 58 have adjustable throttle valves 60 and 62 therein and additional hydraulic lines 64 and 66 communicate the interior of the accumulator 52 with the lines 56 and 58 in a manner bypassing the throttle valves 60 and 62, the lines 64 and 66 being provided with check valves 68 and 70.

When relative pivoting of the sections 12 and 14 causes the piston rod portion 42 to be retracted, hydraulic fluid is returned to the accumulator 52 through the line 58 under the control of the throttle valve 62, the check valve 70 preventing return flow of hydraulic fluid to the accumulator 52 through the line 66, and hydraulic fluid is conveyed from the accumulator 52 through the line 64 and its check valve 68 into the line 56 on the side of throttle valve 60 remote from accumulator 62 whereupon the fluid may freely pass into the cylinder portion 46. Of course, the operation of the hydraulic circuit illustrated in FIG. 7 is reversed when relative angular displacement of the sections 12 and 14 causes extension of the piston rod portion 42. In addition, each of the lines 56 and 58 is provided with a pressure monitoring gauge 70. By adjusting the throttle valves 60 and 62 relative angular displacement of the sections 12 and 14 is dampened.

It will be noted from FIGS. 3 and 4 of the drawings that the longitudinal bottom planing surface 72 of the section 12 is spaced below the adjacent longitudinal bottom planing surface 74 of the section 14, thereby defining a step. Further, it will be noted that the step is ventilated. Also, from FIG. 3 of the drawings it may be seen that the piston rod portions 30 are stabilized by means of a double link stabilizing linkage 76 connected between an intermediate portion of the piston rods 30 and the rear bulkhead 18 of the fore hull section 12.

It is also to be noted that when the pivot shaft 26 is elevated relative to the section 12 the vertical extend of the step defined between the planing surfaces 72 and 74 is increased. Furthermore, it is to be noted that the mounting plates 38 and 40 and the hydraulic cylinders 44 may be disposed below the upper deck surface portions of the hull sections 12 and 14, if desired.

With attention invited more specifically to FIG. 5 of the drawings there may be seen a modified form of hull referred to in general by the reference numeral 10' and which includes structural features which are substantially identical to many of the structural features of the hull construction 10 and which are therefore designated by corresponding prime reference numerals. The hull section 12' includes pairs of opposite side mounting plates 16' and 16'' corresponding to the plates 16, a center mounting plate 17 and the hull section 14' includes single opposite side mounting plates 20' and a pair of transversely spaced central mounting plates 21. The plates 20' are received between the corresponding opposite side mounting plates 16' and 16'' and the mounting plate 17 is received between the mounting plates 21. However, a pivot shaft 26' corresponding to the pivot shaft 26 is rotatably received through the mounting plates 16', 16'', 17, 20' and 21. It will therefore be noted that the pivot shaft 26' is not vertically adjustable relative to the hull section 12'. Further, the aft bottom planing surface 74' is faired as at 75 to reduce water turbulence to a minimum when maneuvering at low speed, but the fairing does not interfere with the ability for air to pass freely downwardly between the hull sections 12' and 14' at the step to eliminate any suction beneath the aft planing surface 74 at planing speeds. Of course, the hull 10' includes hydraulic cylinder construction 46' corresponding to the cylinder constructions 46 interconnecting the upper portions of the hull section 12' and 14'.

Figure 1:
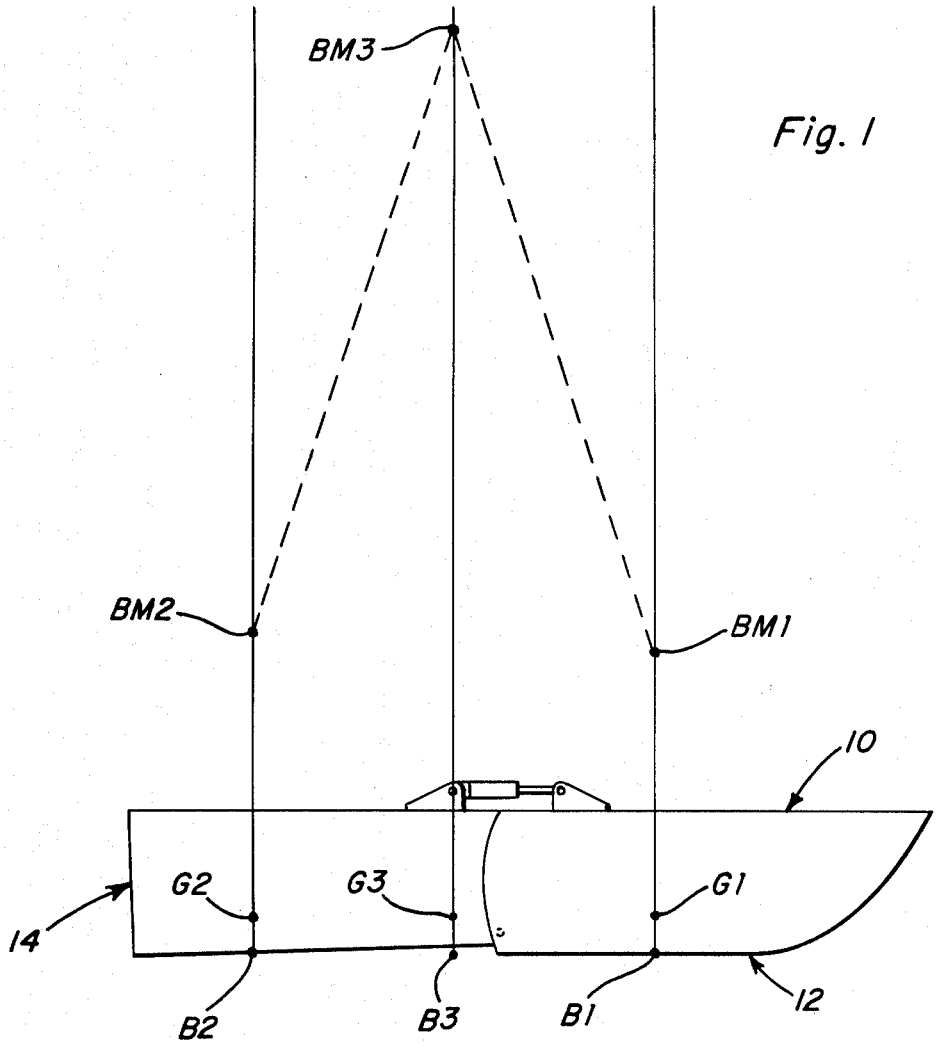
FIG. 1 is a side elevational view of the hull construction of the instant invention with the effective high metacenter of the entire hull when in a rigid condition, the effective lower metacenters of the individual hull sections, the centers of gravity of the front and rear sections as well as the center of gravity for the combined hull sections and the centers of lift for the front and rear sections as well as the combined center of lift for the entire hull section indicated thereon.

With attention now invited more specifically to FIG. 1 of the drawings the metacenter of the hull construction 10, when rigid, is indicated as at BM3 and the metacenters of the sections 12 and 14 are indicated as at BM1 and BM2. Further, the center of gravity of the hull construction 10, when rigid, is indicated at G3 and the centers of gravity of the hull sections 12 and 14 are indicated at G1 and G2. Further, the center of lift, buoyancy or pitch of the hull construction 10, when rigid, is indicated as at B3 and the centers of lift, buoyancy or pitch of the hull sections 12 and 14 are indicated at B1 and B2.

Figure 2A:
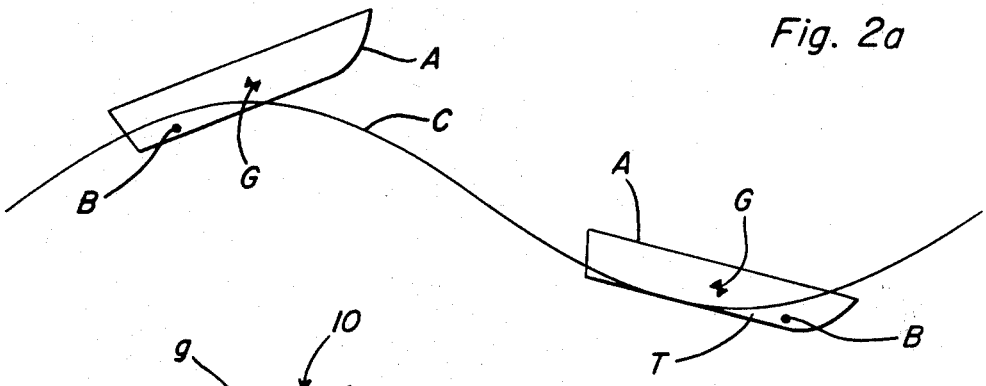

With reference now more specifically to FIGS. **2*a* and 2*b*, FIG. 2*a*** represents the manner in which a conventional planing hull rides over a wave crest and down into a wave trough. The conventional hull A includes a center of gravity G and as the hull A passes over the crest C of a wave the bow of the hull A gravity lifted high out of the water and the center of buoyancy B is moved aft of the center of grvity whereby the aft end of the hull A is buoyed upward while the bow falls sharply. On the other hand, as the hull A bottoms in the trough T, the bow of the hull A digs into the water and the center of buoyancy B is shifted forward of the center of gravity G thus causing the bow of the hull A to rise sharply.

With attention now invited more specifically to FIG. 2*a*, the hull 10 of the instant invention enjoys a center of buoyancy *b* which is only slightly spaced rearward of the center of gravity *g* as the hull 10 crests the wave and a center of buoyancy *b* which is only slightly forward of the center of gravity *g* as the hull 10 bottoms in the trough of the wave. Of course, it will be noted that the bow and stern ends of the fore and aft sections of the hull 10 are swung downwardly as the hull 10 crests the wave and that the bow and stern ends of the fore and aft sections of the hull 10 swing upward as the hull 10 bottoms in the trough of the wave.

With reference now more specifically to FIG. 1 of the drawings, as the throttle valves 60 and 62 are closed less and less emphasis is placed upon the metacenters BM1 and BM2 and more and more emphasis is placed upon the metacenter BM3 until such time as the throttle valves are completely closed and the hull construction 10 is made rigid with the very high metacenter BM3 as experienced by conventional stepped hulls.

By opening the throttle valves 60 and 62 the hull sections 12 and 14 are able to pivot relative to each other about the shaft 26 and the sections 12 and 14 are thereby able to act more as very short independent hull sections in riding over the crest of a wave and down into the trough of a wave. The centers of lift B3, B1 and B2 define axes of pitching of the hull construction 10 when rigid and pitching of the hull sections 12 and 14, respectively. As the bow of the forward section 12 approaches a wave the forward section 12 is able to change its trim about B1 to a more bow-up attitude, thus producing more dynamic lift under the forward hull section 12 and causing the axis B1 to become stronger which, through the hydraulic circuitry of FIG. 7, tends to change the trim of the combined hulls about the axis B3. As the bow of the forward hull section 12 proceeds over the crest of a wave it loses some of its dynamic lift forward causing axis B1 to move aft slightly and section 12 to trim in a bow-downward attitude, thereby further decreasing the lift under the forward section 12 and the hydraulic circuitry of FIG. 7 tends to change the trim of the combined hulls downward about B3. Without the hydraulic system of FIG. 7 the metacenter BM3 would be at its highest value and BM1 and BM2 would be at their lowest values. As the dampening characteristic of the hydraulic circuitry in FIG. 7 is increased in the metacenter would move upward from BM1 and BM2 toward BM3. As the forward hull section 12 changes trim to a bow's-up attitude by rotating through axis B1 and against the hinge shaft 26, it tends to change the trim of the hull section 14 oppositely to a bow-down attitude thereby reducing the dynamic lift under its bottom and further aiding the ability of the hull 10 to follow the contour of the waves.

Figure 2B:
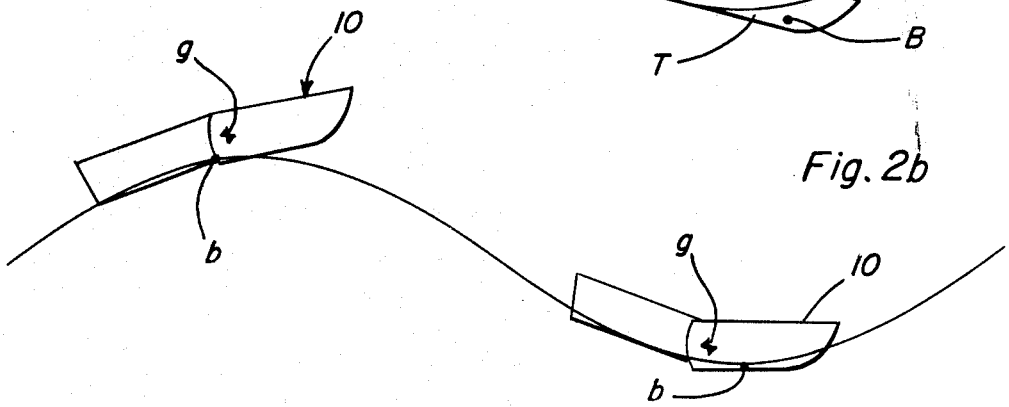

As a conventional hull is driven over the crest of a wave the rigidity of the hull acts to shoot the bow of the hull into the air and the center of lift is moved aft of the center of gravity. This imbalance causes the bow to drop with such force that it is driven into the next wave below the normal waterline. This causes the center of lift to move forward of the center of gravity. This imbalance causes the bow to lift and again shoots the bow off the crest of the next wave with even greater force. When this pitching force of the waves coincides with the natural pitching time period of the hull, the wildest amplitude of pitching will occur. As illustrated in FIG. 2*b* the hull 10 of the instant invention has its center of lift *b* shifted only slightly aft when cresting a wave and shifted only slightly forward when bottoming in the trough of a wave. This effectively dampens all pitching forces making the natural pitching time period almost insignificant. Pitching actions are not amplified, but are dampened.

FIG. 8 graphically represents the water plane area of dynamic moments of the hull 10 and actually results in two greatly longitudinally foreshortened areas of dynamic moments coupled together in tandem thereby dividing, in effect, the one longitudinal metacenter of a conventional hull of similar design into three metacenters, one for the forward section 12, one for the aft section 14 and one for the combined hull sections 12 and 14.

Of course, the hull or boat construction 10' of FIGS. 5 and 6 operates in substantially the same manner as the hull construction 10, with the exception that the axis of oscillation of the hull section 14' relative to the hull section 12' may not be vertically adjusted relative to the hull section 12'. Further, the aft planing bottom surface 74' is faired as at 75 for the purpose hereinbefore set forth. Also, it will be noted from FIGS. 4 and 6 of the drawings that the side plates of the front sections 12 and 12' outwardly overlap the forward ends of the side plates of the sections 14 and 14'.

If it is desired, the valves 60 and 62 may include pressure regulating structure as well as flow throttling structure should it become necessary to "trim" the sections 12 and 14 or the sections 12' and 14' in order to compensate for uneven loading of the hull sections or increased bow wave pressures acting upon the forward portions of the hull sections 12 and 12' while the hulls 10 and 10' are operating at speeds just below planing speeds.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination, a boat hull including fore and aft hull sections, pivot means pivotally interconnecting said sections for relative angular displacement of said sections about a horizontal transverse axis between predetermined limits, and connecting means interconnected between said sections remote from said pivot means operative to adjustably yieldingly resist relative angular displacement of the hull sections, said pivot means including adjustment means for adjustably vertically shifting one of said sections and said axis relative to the other of said sections.

2. The combination of claim 1 wherein said fore and aft sections include generally longitudinally straight adjacent bottom surface portions, said adjustment means defining a lower limit of shifting of said axis relative to said other section, the bottom surface portion of said aft section being spaced above the level of the bottom surface portion of said fore section when said axis is adjusted to its lower limit position.

3. The combination of claim 2 wherein the forward end of said bottom surface portion of said aft section is flared downwardly toward the rear end of the bottom surface portion of said fore section.

4. The combination of claim 1 wherein said connecting means comprises double acting fluid cylinder means connected between said sections for extension and retraction in response to relative oscillation of said sections, and a closed hydraulic circuit communicating the opposite ends of said cylinder means including adjustable throttle valve means for variably throttling the flow of fluid relative to said opposite ends.

5. The combination of claim 1 wherein the pivotal interconnection between said sections defines a transverse air outlet at the rear of the bottom surface of said fore section and air passage means opening upwardly above the water line of said sections.

6. The combination of claim 1 wherein said sections include opposite upstanding sides, the rear marginal edges of the sides of said fore section being lapped outwardly over the forward marginal edges of the sides of said aft section.

7. The combination of claim 1 wherein said one section comprises said aft section, said means for adjustably vertically positioning the aft section and said axis relative to said fore section including fluid motor means.

8. In combination, a boat hull including fore and aft hull sections, pivot means pivotally interconnecting said sections for relative angular displacement of said sections about a horizontal transverse axis between predetermined limits, and connecting means interconnected between said sections remote from said pivot means operative to adjustably yieldingly resist relative angular displacement of the hull sections, said pivot means including adjustment means for adjustably vertically shifting one of said sections and said axis relative to the other of said sections, the pivotal interconnection between said sections defining a transverse air outlet at the rear of the bottom surface of said fore section and air passage means opening upwardly above the water line of said sections, said sections including opposite upstanding sides, the rear marginal edges of the sides of said fore section being lapped outwardly over the forward marginal edges of the sides of said aft section, said fore and aft sections include generally longitudinally straight adjacent bottom surface portions, said adjustment means defining a lower limit of shifting of said axis relative to said other section, the bottom surface portion of said aft section being spaced above the level of the bottom surface portion of said fore section when said axis is adjusted to its lower limit position.

9. The combination of claim 8 wherein the forward end of said bottom surface portion of said aft section is flared downwardly toward the rear end of the bottom surface portion of said fore section.

10. In combination, a boat hull including fore and aft hull sections, pivot means pivotally interconnecting said sections for relative angular displacement of said sections about a horizontal transverse axis between predetermined limits, and connecting means interconnected between said sections remote from said pivot means operative to adjustably yieldingly resist relative angular displacement of the hull sections, said fore and aft hull sections including interdigitated rearwardly and forwardly projecting mounting plates, and transverse pivot shaft means extending between and pivotally connecting said plates defining said axis, the mounting plates of said fore section including transversely registered upstanding slots through which said pivot shaft means extends and along which the pivot shaft means is adjustably shiftable.

11. In combination, a boat hull including fore and aft planing hull sections, pivot means pivotally interconnecting said sections for relative angular displacement about a horizontal transverse axis closely spaced above the lower planing surfaces of said sections and for relative movement of said sections between predetermined limits with the bow and stern portions of said fore and aft hull sections inclined upwardly and downwardly relative to horizontal positions thereof, and hull section relative angular displacement connecting means interconnected between upper portions of said sections above said pivot means, said connecting means including (1) thrust developing means operative, when the forward section bow crests a wave and thus experiences a reduction of buoyancy force thereon from the water, to swing said forward section toward a bow downward attitude relative to said aft section and (2) yieldable hull section relative angular displacement retaining means operative, when the forward section bow bottoms in a trough between wave crests and thus experiences an increase in buoyancy force thereon from the water, to allow said bow section to swing toward a bow up attitude relative to said aft section, said thrust developing means, by the adjusted thrust developed thereby, also serving to overcome the normal tendency of said bow and stern sections, due to their buoyancy, to assume bow up and stern up attitudes, and obtain the desired mean relative pitch attitudes thereof, to be determined by the loading of said hull sections, speed of said hull and water conditions.

* * * * *